US006477749B1

(12) United States Patent
Reiter

(10) Patent No.: US 6,477,749 B1
(45) Date of Patent: Nov. 12, 2002

(54) MAGNETIC TACK

(75) Inventor: Howard J. Reiter, Orange, CT (US)

(73) Assignee: Lodestone Fasteners, LLC, Woodbridge, CT (US)

( * ) Notice: Subject to any disclaimer, the term of this patent is extended or adjusted under 35 U.S.C. 154(b) by 0 days.

(21) Appl. No.: 09/710,334

(22) Filed: Nov. 9, 2000

(51) Int. Cl.[7] ..... A44B 21/00
(52) U.S. Cl. ..... 24/303; 24/66.1; 292/251.5
(58) Field of Search ..... 24/303, 66.1; 292/251.5; 248/206.5

(56) References Cited

U.S. PATENT DOCUMENTS

| | | | | | |
|---|---|---|---|---|---|
| 2,397,931 | A | | 4/1946 | Ellis | |
| 2,731,663 | A | * | 1/1956 | Thompson | 292/251.5 |
| 2,907,085 | A | * | 10/1959 | Bosland | 24/303 |
| 3,009,225 | A | | 11/1961 | Budreck | |
| 3,041,697 | A | | 7/1962 | Budreck | |
| 3,141,214 | A | * | 7/1964 | Bey | 24/303 |
| 3,277,681 | A | | 10/1966 | Bey | |
| 3,288,511 | A | * | 11/1966 | Tavano | 292/251.5 |
| 3,664,292 | A | * | 5/1972 | Sherman | 116/114 |
| 4,021,891 | A | | 5/1977 | Morita | |
| 4,453,294 | A | | 6/1984 | Morita | |
| 4,736,494 | A | | 4/1988 | Marchesi | |
| 4,995,655 | A | * | 2/1991 | Freeman | 292/251.5 |
| 5,142,746 | A | | 9/1992 | Morita | |
| 5,722,126 | A | | 3/1998 | Reiter | |
| 5,864,272 | A | * | 1/1999 | Hoffmann | 335/207 |
| 5,933,926 | A | | 8/1999 | Reiter | |
| 6,131,247 | A | * | 10/2000 | Morita | 24/303 |
| D434,644 | S | | 12/2000 | Aoki | |

FOREIGN PATENT DOCUMENTS

| | | |
|---|---|---|
| GB | 1519246 | 7/1978 |
| JP | 60-5049 | 2/1985 |

* cited by examiner

*Primary Examiner*—Victor Sakran
(74) *Attorney, Agent, or Firm*—Cooper & Dunham LLP

(57) ABSTRACT

A magnetic tack for fastening items to a metal magnetic surface. The magnetic tack includes a knob connected to a body consisting of a plate, a magnet and a non-magnetic cover.

11 Claims, 13 Drawing Sheets

MAGNETIC TACK

BACKGROUND

The present invention relates to a magnetic tack for fastening items to soft-magnetic surfaces. Soft-magnetic materials are known in the field of magnetism to be ones onto which a permanent magnet (called a hard-magnetic material) will stick.

Magnetic snap fasteners are known for use as closures. U.S. Pat. Nos. 5,722,126 and 5,933,926, issued to Applicant, entitled "Magnetic Snap Fasteners", relate to magnetic snap fasteners of different configurations. These fasteners comprise a male and a female section which are magnetically coupled at a single position. These fasteners have projections or rivets on each section which engage to assist in the magnetic attraction between the male and female sections by closing a magnetic circuit. The projection or rivets may have holes extending therethrough.

U.S. Pat. No. 4,453,294, issued to Morita, entitled "Engageable Article Using Permanent Magnet", as reexamined and confirmed under Reexamination Certificate B1 U.S. Pat. Nos. 4,453,294, and 4,021,891, also issued to Morita, entitled "Magnetic Lock Closure," as reexamined and confirmed under Reexamination Certificate B2 U.S. Pat. No. 4,021,891, relate to a magnetic closure wherein a solid projection on a first half of the closure engages a solid projection on a second half of the closure, which also contains a circular magnet. The Morita '294 and Morita '891 patents essentially describe the same product. These patents show solid projections or rivets. Further, British Patent Specification No. 1,519,246, published Jul. 26, 1978, discloses a magnetic closure, wherein the projections are partially hollow. None of these prior patented devices are practical for use by themselves to attach items to a soft magnetic surface, such as a wall, since they do not have a convenient means for grasping the fastener to put it on or remove it from the wall. The backs of these devices have attachment means for mounting the fasteners to handbags and the like in male/female pairs. These attachment means are not suited to grasping by a hand.

It also is known to use flat magnets, usually containing an advertising gimmick, to fasten items to soft-magnetic surfaces. These flat magnets generally do not possess enough magnetic force to fasten and support more than a single sheet of paper to a surface.

Conventional thumb tacks can, of course, be used to fasten paper items to non-metallic surfaces. Thumb tacks pierce the documents being tacked and damage them. Their dangerous sharp points are a hazard to children and adult users. Also, conventional thumb tacks are not designed with the ability to support and fasten large packs of paper to a surface and cannot be used to fasten paper items to a metallic surface, such as a refrigerator, or white board.

OBJECTS AND SUMMARY OF THE INVENTION

In view of the aforementioned shortcomings of conventional flat magnets, thumb tacks and magnetic snap fasteners, it is an object of the present invention to provide a magnetic tack for fastening items to soft-magnetic surfaces.

It is another object of the present invention to provide a magnetic tack with the utility and ability to support packs of paper and without damaging the paper.

It is also an object of the invention to provide a child proof and safe tack.

To these and other ends, the present invention contemplates a magnetic tack for fastening an item, such as paper, to a soft-magnetic surface, such as a white board, home refrigerator, wall strip, or other magnetically attractable apparatus or device to which the magnetic tack can stick. The tack includes a plate of soft-magnetic material and a non-magnetic cover which encase a magnet. A knob is secured to the plate to assist in handling the tack. A pin or projection can extend through a hole in the magnet to create a magnetic circuit that will channel magnetic flux in such a manner that the magnet will use its power with improved efficiency. The projection may be hollow or solid. The pin can connect the knob to the magnetic tack. Alternatively, the plate can incorporate sidewalls which conduct magnetic flux to create a magnetic circuit that will channel magnetic flux in such a manner that there will be reduced loss of magnetic power due to flux leakage. As another alternative, the magnetic tack can incorporate both a pin and sidewalls. The knob can be joined to the encased magnet in a variety of ways which may include rivets, screws, glue, solder, welding, or any other form of joining.

The advantages of the invention will become apparent from the detailed description and drawings.

DETAILED DESCRIPTION OF PREFERRED EMBODIMENTS

Figure 1:
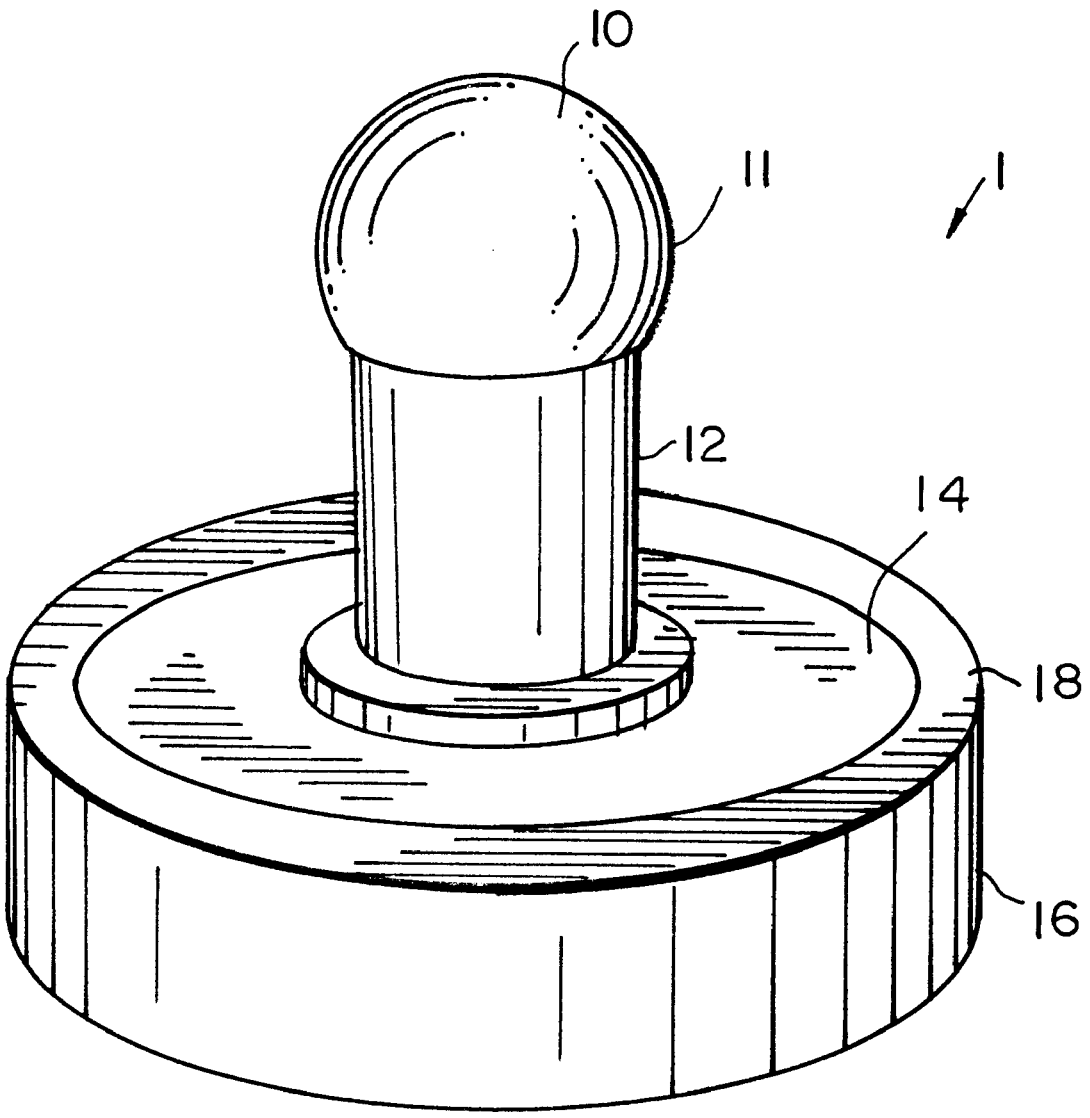
FIG. 1 is a perspective view of one embodiment of a magnetic tack in accordance with the invention.

Preferred embodiments of the present invention are described below with reference to the accompanying drawings, in which like reference numerals represent the same or similar elements.

Figure 2:
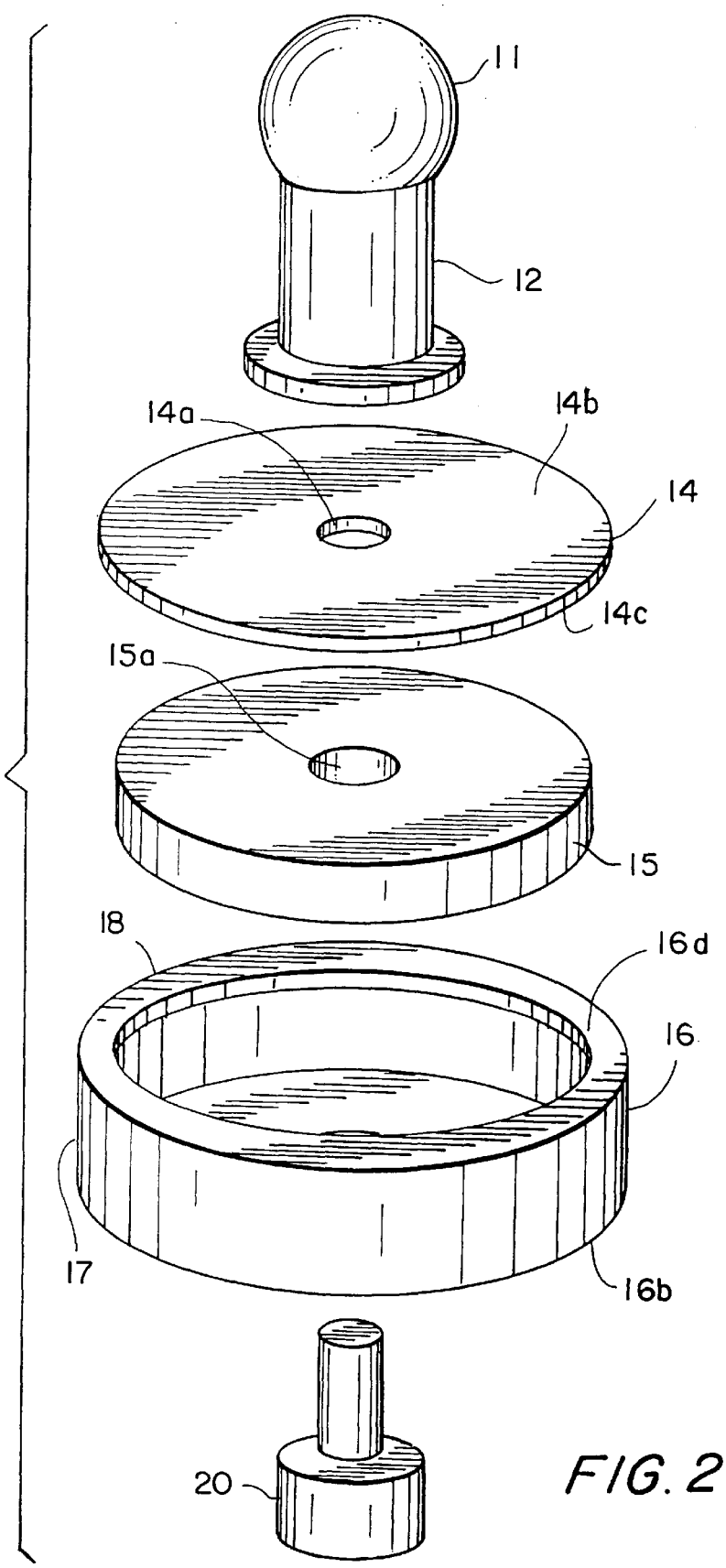
FIG. 2 is an exploded view of the magnetic tack of FIG. 1.

As shown in FIGS. 1 and 2, magnetic tack 1 includes a knob 10, a non-magnetic cover 16 secured to a circular plate 14, and a circular magnet 15 contained between plate 14 and cover 16. Pin or projection 20 connects to knob 10.

As shown in FIG. 2, circular plate 14 may be made of a ferromagnetic material and includes central hole 14*a,* top side 14*b,* and bottom side 14*c.*

Figure 7:
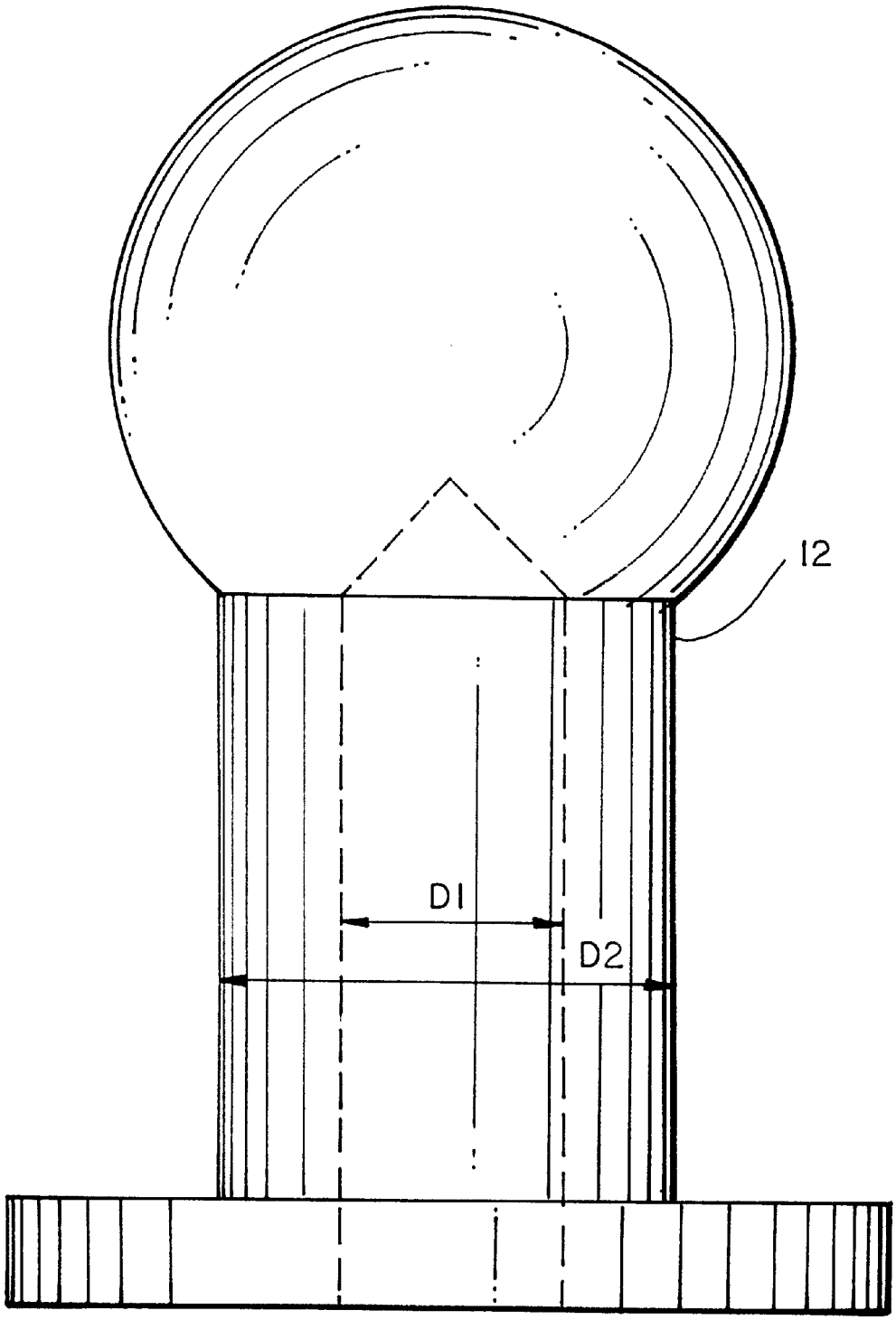
FIG. 7 is an elevational view of the knob used in FIG. 1.

As shown in FIGS. 2 and 7, knob 10 has a knob head 11 and knob body 12. Knob 10 is positioned against circular plate 14. Knob 10 can be of any convenient shape. Knob 10 may be made of any material.

Figure 3B:
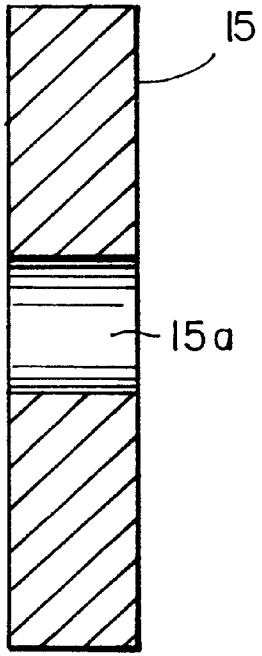
FIGS. 3*a* and 3*b* are a top view and a side cut-away view, respectively, of the circular magnet used in FIG. 1.
Figure 3A:
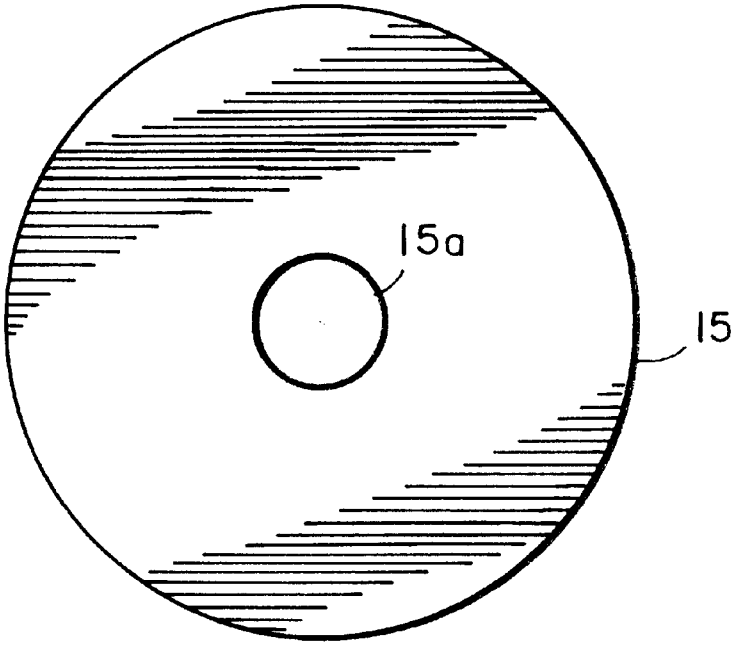
Figure 5:
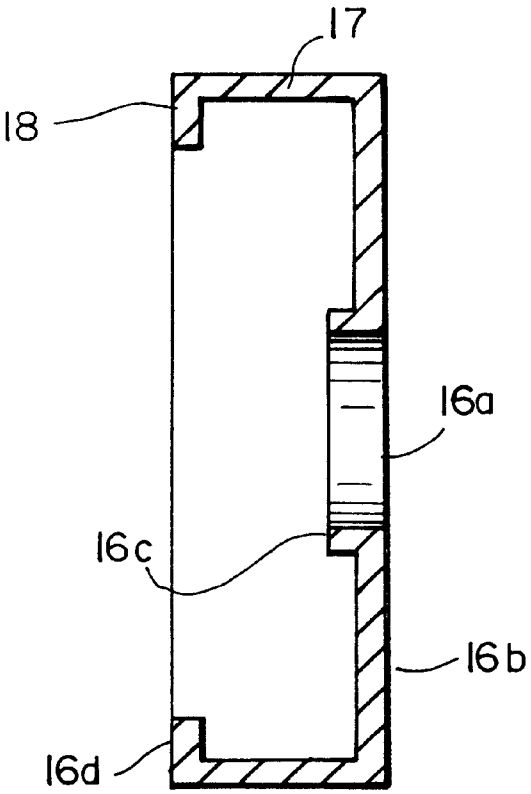
FIGS. 4 and 5 are a top view and a side cut-away view, respectively, of the non-magnetic cover used in FIG. 1.
Figure 4:
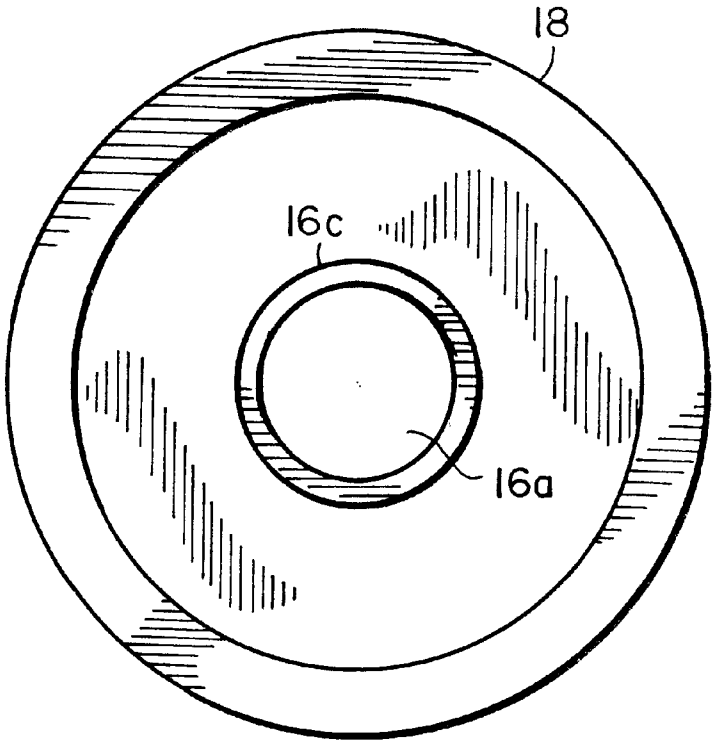
Figure 6:
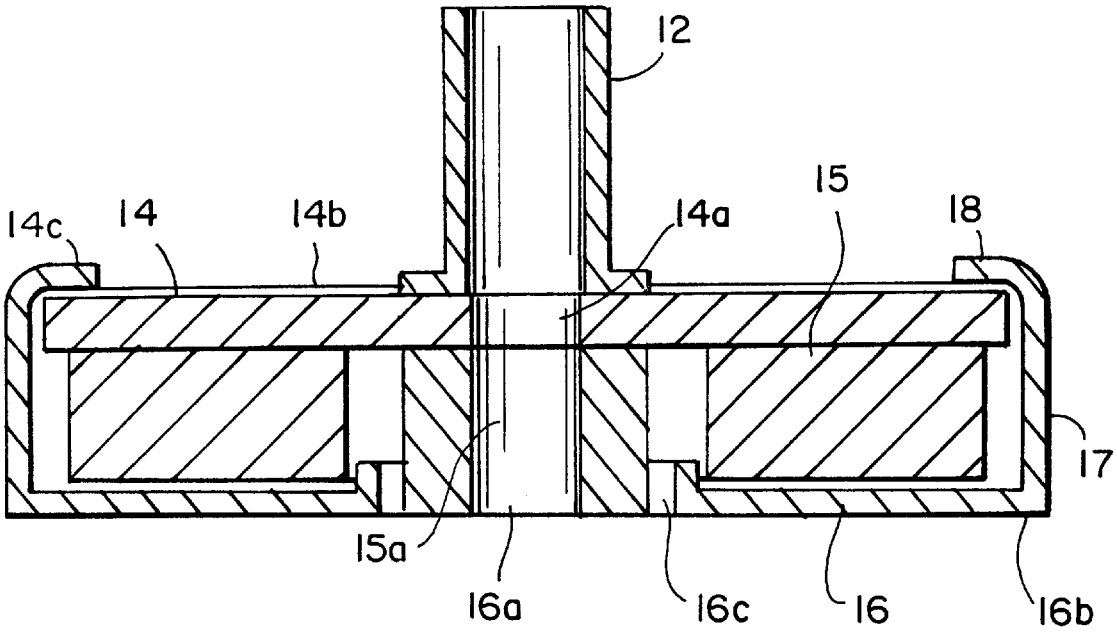
FIG. 6 is a cross-sectional view of a part of the magnetic tack of FIG. 1.

As shown in FIGS. 2, 3*a,* and 3*b,* circular magnet 15 is toroidal in shape and has a central hole 15*a.* Magnet 15 may be made of any "hard" (permanent) magnetic material. Circular magnet 15 is encased by plate 14 and by non-magnetic cover 16 as shown in FIGS. 2, 4, 5, and 6.

Cover 16 has top side 16*d* and side wall 17 and circumscribes magnet 15. Flange 16*c* on bottom side 16*b* of cover 16 helps contain circular magnet 15. Continuous flange 18 on top side 16*d* also maintains magnet 15 in place relative to plate 14. The continuous flange 18 holds the magnet 15 in place more securely than if prongs or tabs are used. However, it is within the scope of the invention to use a plurality of prongs or tabs. Preferably, continuous flange 18 extends about the entire periphery of non-magnetic cover 16. Non-magnetic cover 16 and circular magnet 15 have central holes 16*a* and 15*a,* respectively, which are substantially axially aligned with center hole 14*a* of washer plate 14.

Figure 8:
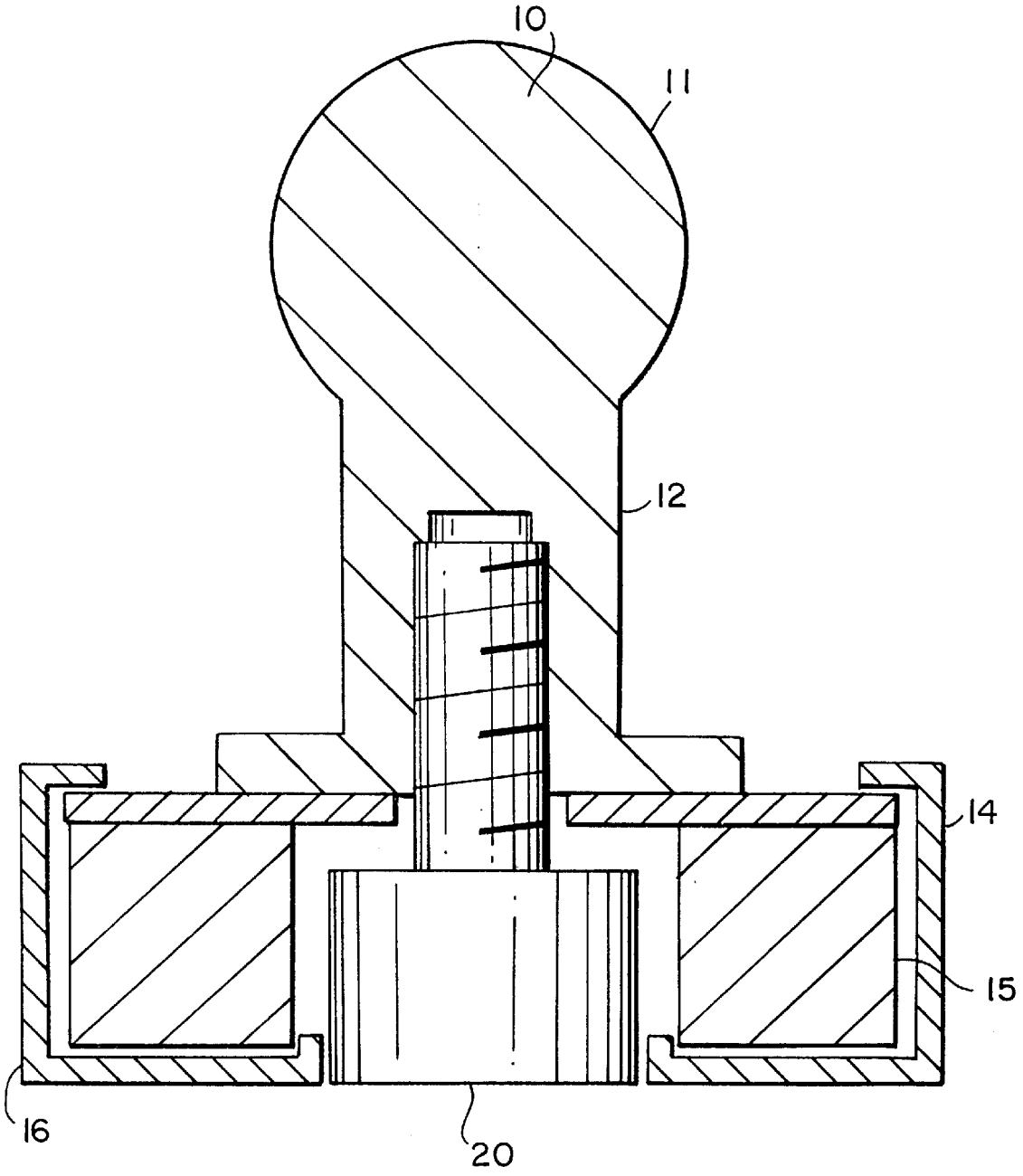
FIG. 8 is a cross-sectional view of another embodiment of a tack with a projection which may be press fitted to the body of the tack.

A projection or pin 20 extends through magnet 15 and is secured to knob body 12 from the bottom side 14*b* of plate 14. The pin 20 shown in FIG. 8 is press fitted into knob body 12. Projection or pin 20, sometimes called a rod, rivet or screw, is made of a soft-magnetic material. The existence of pin 20 serves to facilitate the magnetic attraction of the device to a soft-magnetic surface by making a magnetic circuit that channels magnetic flux from magnet 15. Pin 20 may be solid or hollow, that is, having an interior bore. The advantage of using a solid pin is explained in U.S. Pat. Nos. 4,021,891 and 4,453,294. The advantages of using a hollow pin are explained in U.S. Pat. Nos. 5,722,126 and 5,933,926. The disclosures of those patents are incorporated herein by reference. It is also within the scope of the invention to use a partially hollow pin as shown, for example, in British Patent Specification No. 1,519,246. Some of the components used in the magnetic tack may be interchangeable with those used in the magnetic snaps shown in the aforesaid patents. The top surface of pin 20*a* should preferably extend through the magnet annulus 15*a* and cover 16 and be flush with bottom surface of cover 16*b* but this is not required.

Figure 9:
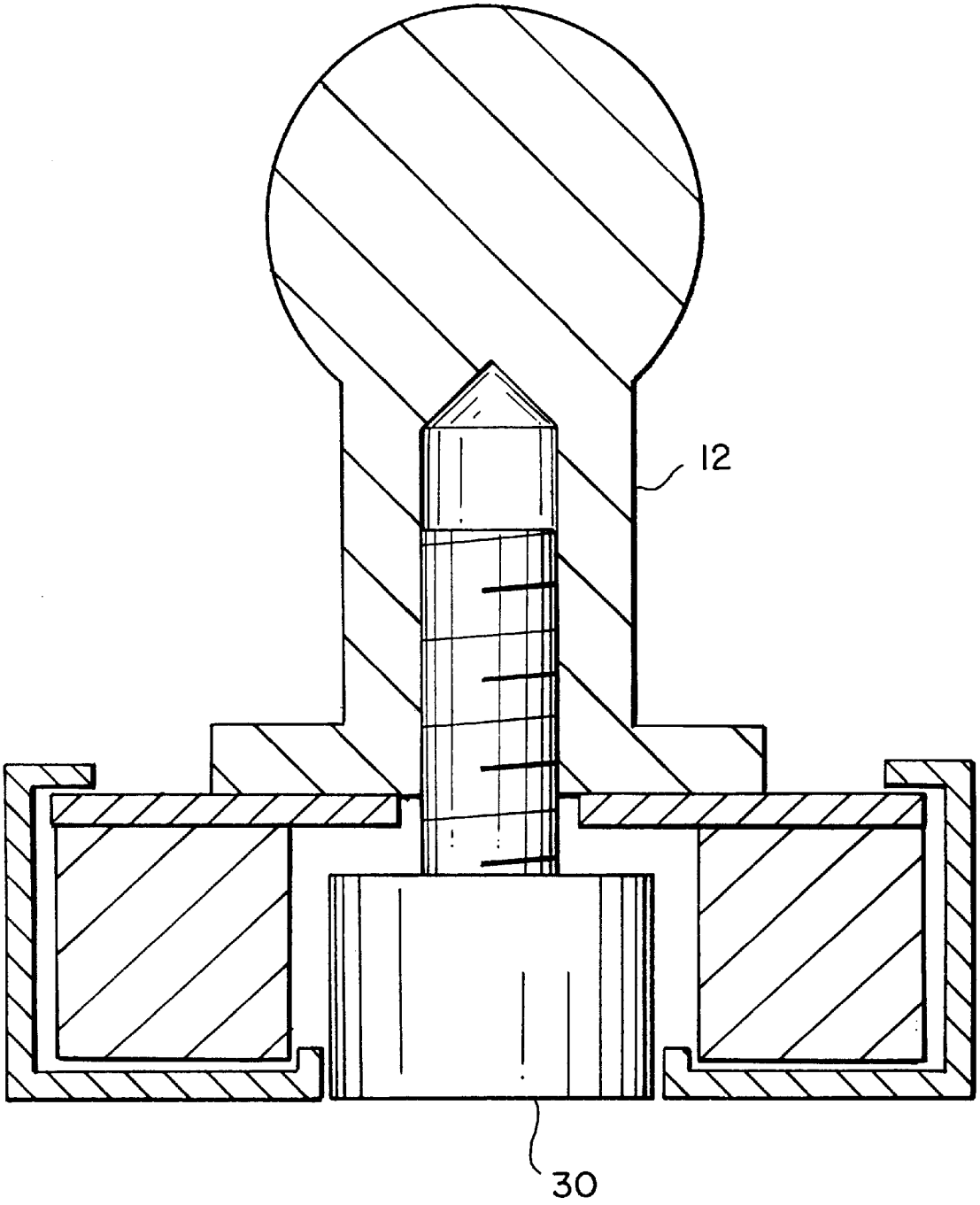
FIG. 9 is a cross-sectional view of a tack with a projection which may be screwed into the body of the tack.

In another embodiment, as shown in FIG. 9, knob body 12 is affixed to the cover/magnetic/plate assembly by pin 30 that is screw-fitted into knob body 12.

Figure 10:
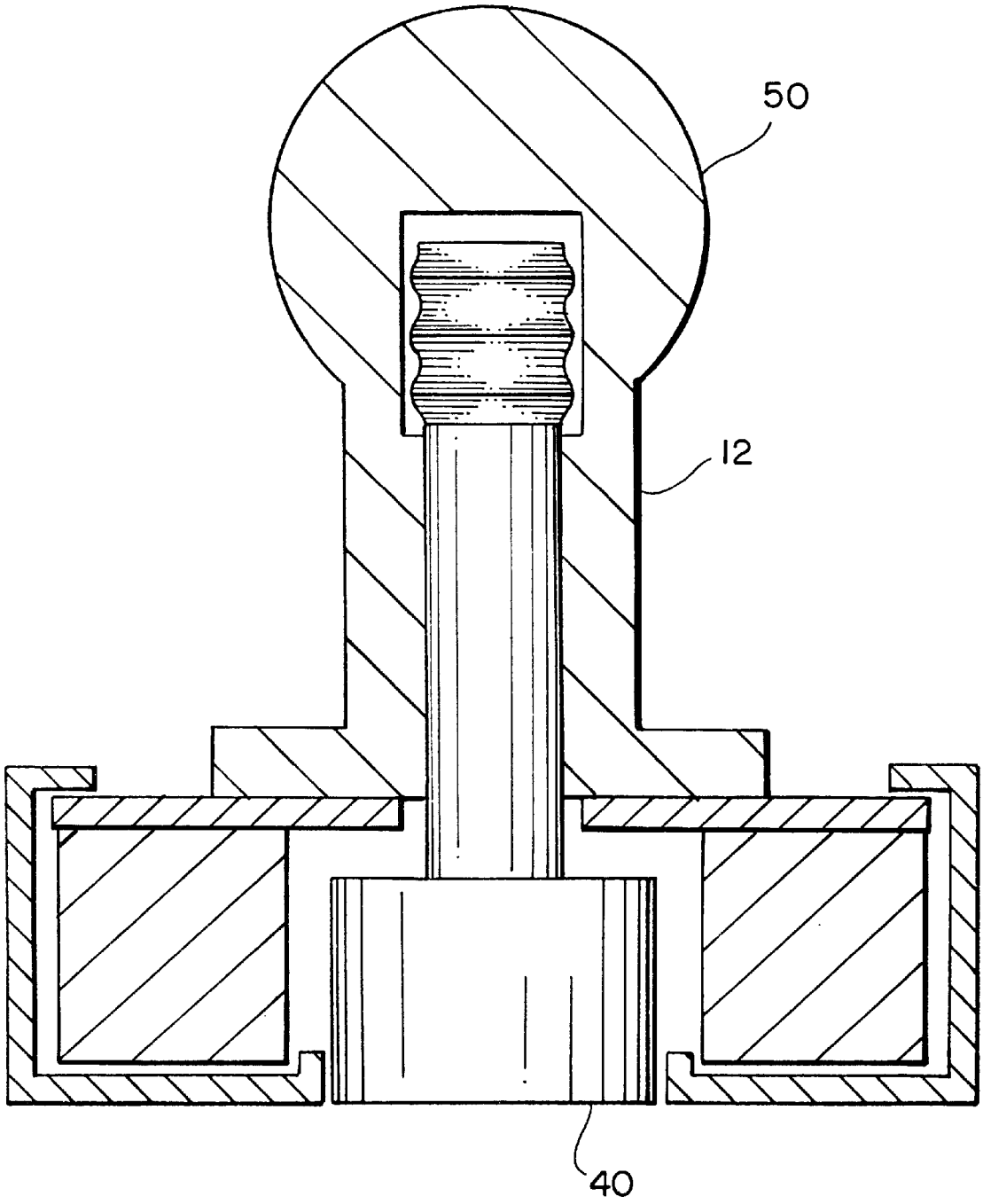
FIG. 10 is a cross-sectional view of a tack with a projection which may have a crush rivet for attachment to the body of the tack.

In another embodiment, as shown in FIG. 10, knob head 10 has an internal undercut 50. Knob body 12 is affixed to the cover/magnetic/plate assembly by a kwik rivet stem pin 40. The kwik rivet stem pin 40 is crush fitted into knob body 12.

Figure 11:
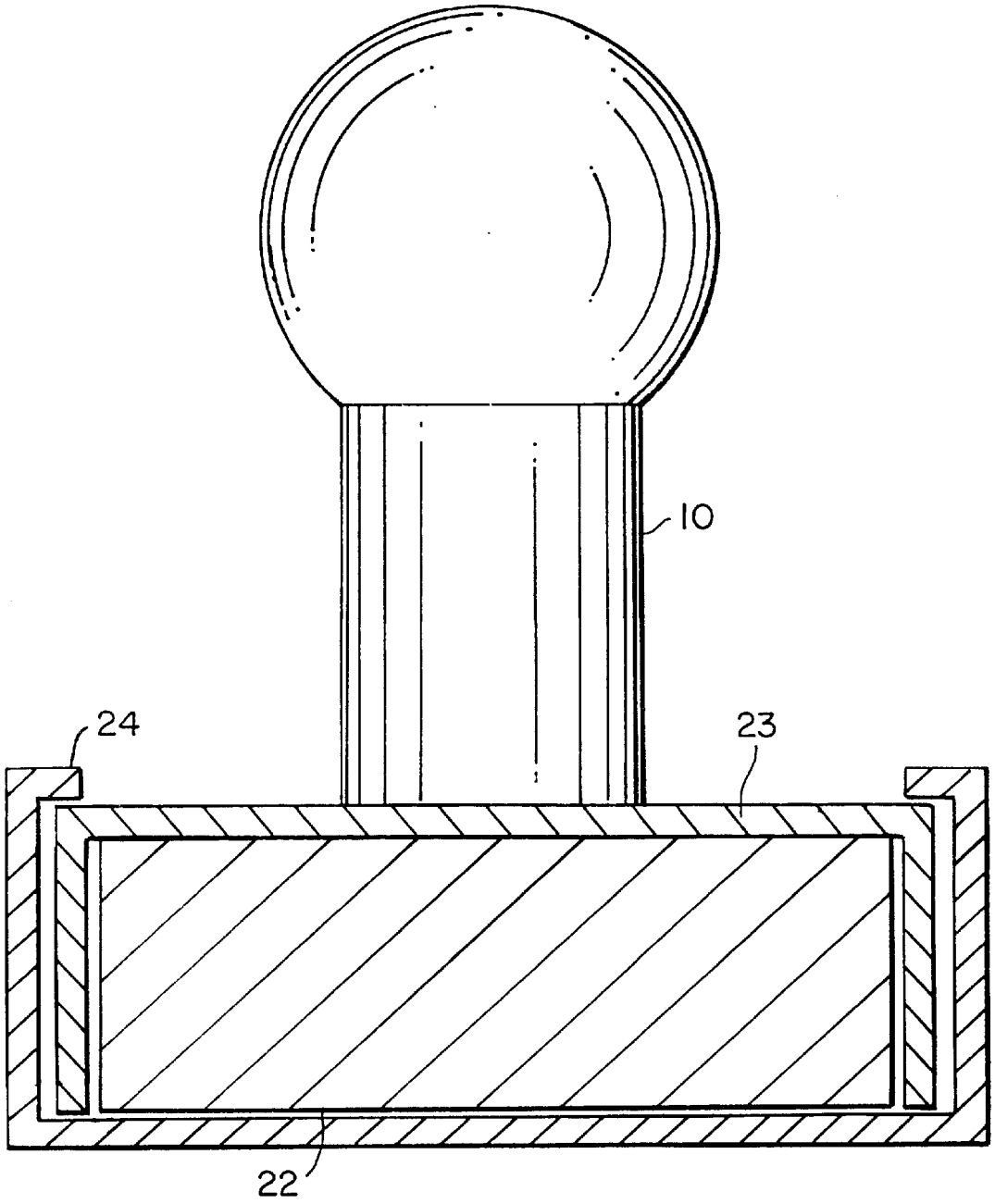
FIG. 11 is a cross-sectional view of an alternative embodiment of the tack incorporating a plate with side walls.

An alternative embodiment shown in FIG. 11 depicts a magnetic tack with solid magnet 22, soft magnetic material plate 23 with side walls 23*a,* cover 24, and knob 10. The side walls 23*a* serve to facilitate the magnetic attraction of the device to a soft-magnetic surface by making a magnetic circuit that channels magnetic flux from magnet 22. Knob 10 is attached by an appropriate means, such as gluing, soldering, or welding.

Figure 12A:
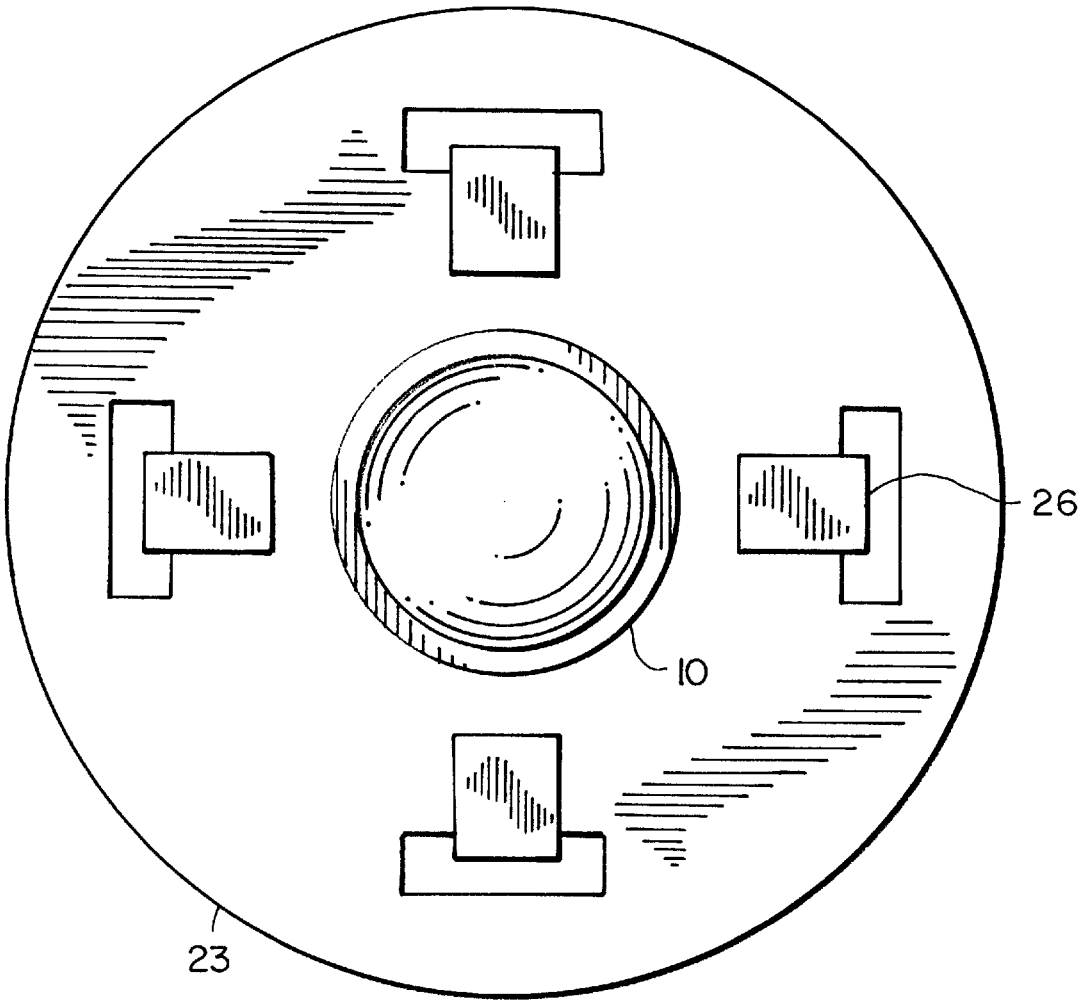
FIGS. 12*a,* 12*b* and 12*c* are a top view and cross-sectional views of another alternative embodiment of the tack incorporating a plate with side walls, and a center pin.
Figure 12B:
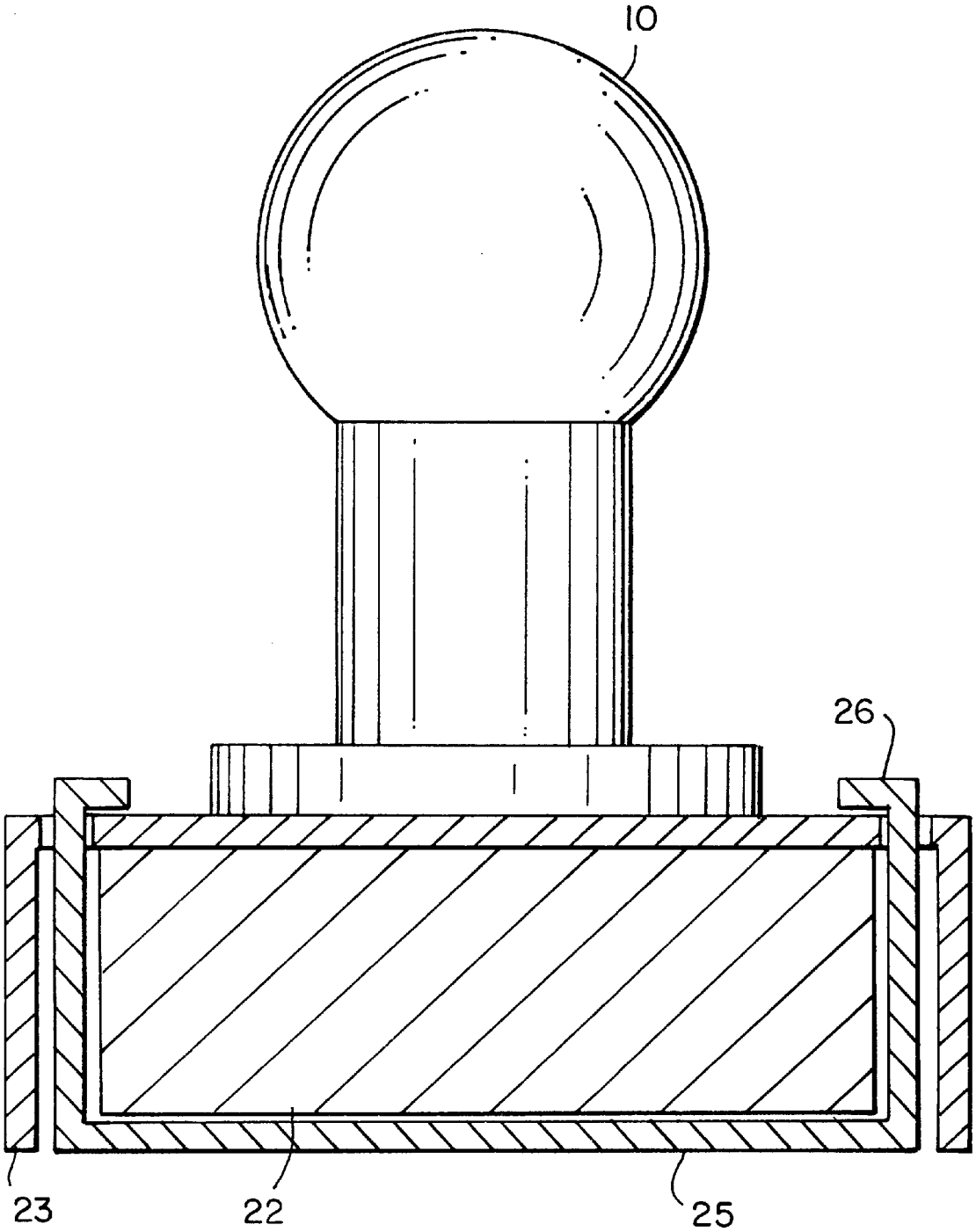
Figure 12C:
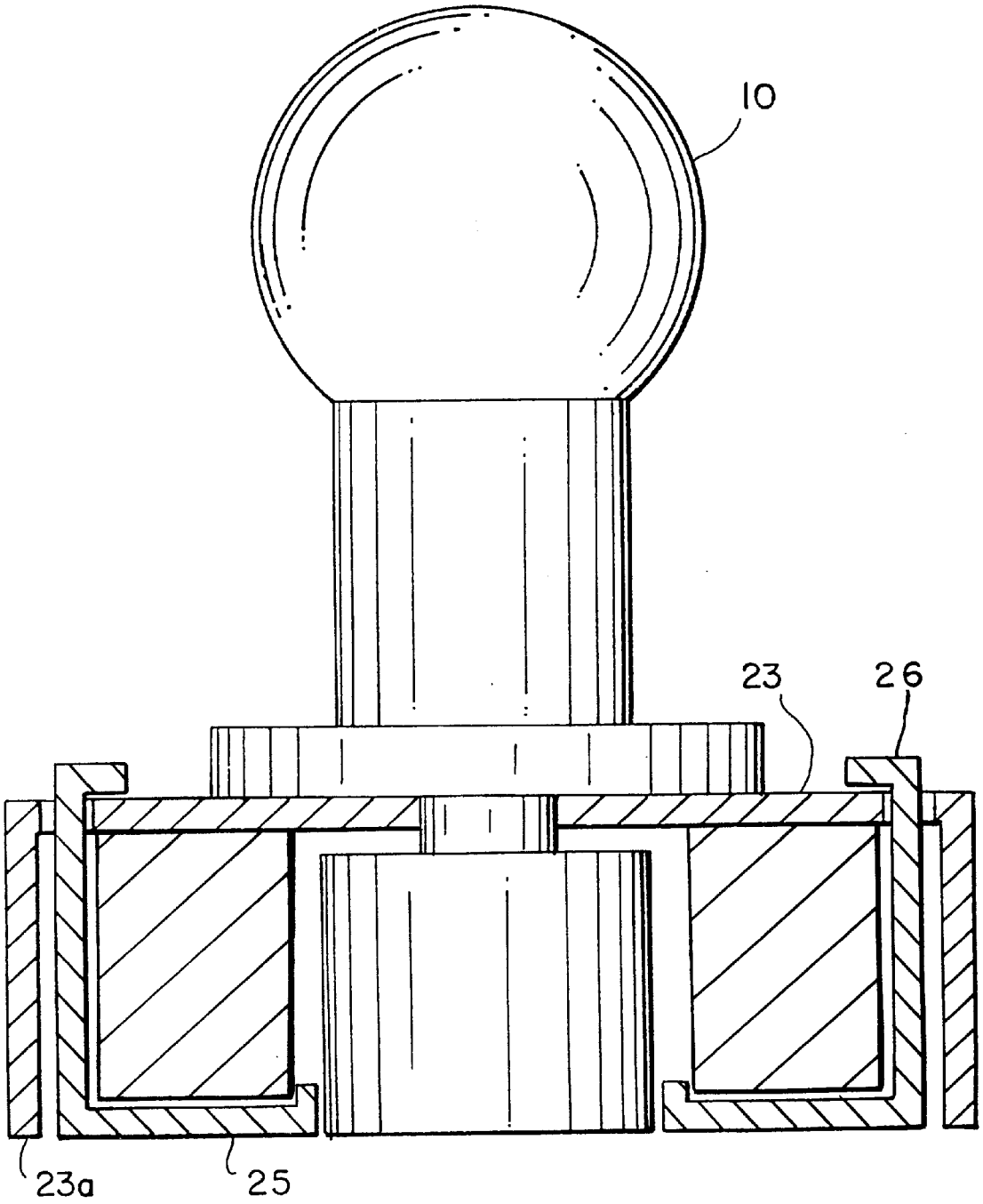

Another embodiment is shown in FIGS. 12*a* and 12*b*. It is similar to the embodiment of FIG. 11 except that non-magnetic cover 25 is attached to plate 23 having side walls 23*a*. This embodiment has a series of tabs 26 extending through slots 27 in plate 23. Tabs 26 are folded over to fasten the cover to the plate 23. Knob 10 is attached by an appropriate means, such as gluing, soldering, or welding. In place of the tabs shown, the cover can be press fit into side walls 23*a,* or it can be glued, soldered, or welded in place to side walls 23*a*.

Still another embodiment combines both side walls and a pin, as shown in FIGS. 11, 12*a,* 12*b* and 12*c*. Cover 28 can attach either inside or outside the side walls 23*a*. Knob 10 can be attached by any of the methods previously described.

Various changes and modifications may be effected by one skilled in the art without departing from the spirit or scope of the invention as defined in the appended claims. As an example, the flange in the non-magnetic cover can be a series of tabs, rather than a continuous piece. As another example, the knob may be welded to the top side of the plate rather than secured to the pin.

What is claimed is:

1. A magnetic tack for fastening an item to a magnetic surface, comprising:

a plate defining a first hole in the center thereof and having a top side and a bottom side;

a magnet defining a second hole in the center thereof;

a non-magnetic cover defining a third hole in the center thereof, whereby the magnet is secured between the bottom side of the plate and the non-magnetic cover;

whereby the first, second and third holes are axially aligned;

a knob attached to the top side of the plate; and a pin extending through the first, second and third holes and into contact with the knob to attach the knob to the plate.

2. The magnetic tack of claim 1, wherein the pin is fitted through the first, second and third holes and pressed into the knob, to attach the knob to the top side of the plate.

3. The magnetic tack of claim 1, wherein the pin is a screw extending through the first, second and third holes into the knob to attach the knob to the top side of the plate.

4. The magnetic tack of claim 1, wherein the pin is a rivet fitted through the first, second and third holes into the knob, which when compacted, attaches the knob to the top side of the plate.

5. A magnetic tack for fastening an item to a magnetic surface, comprising:

a circular plate defining a first hole in the center thereof and having a top side and a bottom side;

a circular magnet defining a second hole in the center thereof;

a circular non-magnetic cover defining a third hole in the center thereof and having a side wall and a peripheral flange, whereby the circular magnet is secured between the bottom side of the circular plate and the non-magnetic cover by the peripheral flange and whereby the first, second and third holes are axially aligned;

a knob attached to the top side of the circular plate; and attachment means extending through the first, second and third holes and into contact with the knob for affixing the knob to the top side of the circular plate.

6. The magnetic tack of claim 5, wherein the peripheral flange is continuous and is wrapped about the circular edge of the circular plate.

7. The magnetic tack of claim 5, wherein the peripheral flange comprises at least two tabs which are fastened to the circular edge of the circular plate.

8. The magnetic tack of claim 5, wherein the attachment means is a pin.

9. The magnetic tack of claim 5, wherein the attachment means is a screw.

10. The magnetic tack of claim 5, wherein the attachment means is a rivet.

11. The magnetic tack of claim 5, wherein the circular plate has peripheral side walls extending therefrom.

* * * * *